US006570110B2

(12) United States Patent
Narasimhan

(10) Patent No.: US 6,570,110 B2
(45) Date of Patent: May 27, 2003

(54) GALLIUM BASED ELECTRICAL SWITCH HAVING TANTALUM ELECTRICAL CONTACTS

(76) Inventor: Dave Narasimhan, 6 Summit Trail, Flemington, NJ (US) 08822

( * ) Notice: Subject to any disclaimer, the term of this patent is extended or adjusted under 35 U.S.C. 154(b) by 0 days.

(21) Appl. No.: 09/909,618

(22) Filed: Jul. 20, 2001

(65) Prior Publication Data

US 2003/0015409 A1 Jan. 23, 2003

(51) Int. Cl.[7] ..... H01H 29/04
(52) U.S. Cl. ..... 200/233; 200/61.47; 200/220
(58) Field of Search ..... 200/182, 220, 200/233, 234, 235, 262, 263, 266, 285, 61.47

(56) References Cited

U.S. PATENT DOCUMENTS 3,462,573 A 8/1969 Rabinowitz et al. ..... 200/152
3,670,130 A * 6/1972 Greenwood ..... 200/183
4,652,710 A * 3/1987 Karnowsky et al. ..... 200/182
5,391,846 A 2/1995 Taylor et al. ..... 200/233
5,478,978 A 12/1995 Taylor et al. ..... 200/233
5,508,003 A 4/1996 Rancourt et al. ..... 420/555
5,751,074 A * 5/1998 Prior et al. ..... 200/190
5,792,236 A 8/1998 Taylor et al. ..... 75/715
6,323,447 B1 * 11/2001 Kondoh et al. ..... 200/182

* cited by examiner

*Primary Examiner*—Michael Friedhofer

(57) ABSTRACT

An electrical switch comprised of a housing defining a cavity, at least two spaced electrodes extending through the housing into the cavity, and wherein at least one of said at least two electrodes is composed of gallium wetted tantalum or tantalum alloy, and a moveable amount of liquid gallium or liquid gallium alloy within the cavity to electrically connect and disconnect any two of said at least two electrodes as a result of movement of the housing.

12 Claims, 5 Drawing Sheets

GALLIUM BASED ELECTRICAL SWITCH HAVING TANTALUM ELECTRICAL CONTACTS

FIELD OF THE INVENTION

The invention is in the field of electrical switches, in particular, electrical switches relying on liquid gallium metal or liquid gallium alloy as a bridging electrical conducting material.

BACKGROUND OF THE INVENTION

Electrical tilt switches and sensors such as thermostats, float controls, solenoids, relays, etc. are commonly used in a variety of electrical applications. The making or breaking of electrical contact in these switches, hence the electrical switching action, is generally accomplished by mechanical movement or tilting of the switch which causes a quantity of a bridging conducting material, commonly liquid mercury metal, contained therein to flow from one location to another. In a typical switch application, liquid mercury is positioned inside a housing into which a pair of spaced electrodes or electrical contacts extend. Depending on the physical orientation of the housing, the liquid mercury can provide a conductive pathway between the electrodes or be positioned such that there is an open circuit between the electrodes. The switch is closed and electrical contact made when the switch housing is moved in a manner such that the quantity of mercury flows toward and collects in the switch housing at a location where the mercury bridges the spaced electrodes. Conversely, the switch is opened and electrical contact broken when the switch housing is moved in a manner such that the quantity of mercury flows towards and collects at a different position in the switch housing out of contact with at least one of the electrodes.

In some configurations of these kinds of electrical switches, one electrode remains in continuous contact with the quantity of mercury and the electrical circuit is closed when the mercury contacts the other electrode. In these electrical switch configurations, the electrode that continuously contacts the mercury is referred to as the common electrode, while the electrode that intermittently contacts the mercury as a result of changes in the switch orientation is referred to as the arcing electrode because it is subjected to electrical arcing whenever the electrical circuit is made or broken.

In yet other configurations, there may be more than two electrodes within the switch housing such that more than one electrical circuit may be closed depending on the location of the quantity of mercury, hence the orientation of the switch.

The foregoing configuration, as well as other configurations of mercury-based electrical switches, and their applications, would be known to persons skilled in the art.

A problem with mercury-based electrical switches is the mercury is toxic to humans and animals, and exposure to mercury is a significant concern in any application or process in which it is used. Utilization of mercury during manufacturing may present a health hazard to plant personnel, and the disposal of devices that contain mercury switches or the accidental breakage of mercury switches during use may present indirect hazard to people within the immediate vicinity of the switch.

As a result of the toxicity of mercury, non-toxic replacements for mercury in electrical switch applications have been sought. A candidate for replacing mercury in electrical switches is liquid gallium metal or liquid gallium alloys. For example, U.S. Pat. No. 3,462,573 (Rabinowitz et al.) discloses vacuum type circuit interrupters using a pair of fixed electrodes, or contacts, having liquid gallium metal or liquid gallium alloys as the bridging conducting material between the electrodes or contacts. U.S. Pat. No. 5,391,846 (Taylor et al.) discloses an alloy substitute for mercury in switch applications comprising a gallium-indium-tin eutectic alloy which has been cleaned to remove all oxides. U.S. Pat. No. 5,792,236 (Taylor et al.) discloses a non-toxic liquid metal composition comprising gallium metal or gallium alloy for use as a mercury substitute in, among other things, electrical switches. U.S. Pat. No. 5,478,978 (Taylor et al.) discloses electrical switches and sensors which use a non-toxic liquid metal composition, namely gallium metal or gallium alloy. Each of the above references is hereby incorporated by reference.

The electrodes or electrical contacts in mercury-based switches are commonly molybdenum, tungsten or platinum. However, when gallium is used in electrical switches in place of mercury, it has been found that electrodes comprised of these materials deteriorate relatively rapidly. For example, our experiments show that molybdenum electrodes, tungsten electrodes and platinum electrodes have been found surprisingly to recess or erode rapidly after a relatively low number of arc cycles, which may be due to an interaction between gallium and these metals. As a result, our experience indicates that electrodes composed of platinum, tungsten or molybdenum are generally unsuitable for gallium-based switch applications.

Electrodes in mercury-based switches are also commonly composed of nickel, chromium or iron. Our experience indicates that thinning of the electrodes comprising either one of these metals may result from immersion in gallium, but the process may be slow if the operational temperature of the gallium-based switch is kept low. Consequently, these metals may be used as common electrodes in gallium-based switches. However, it has been found that each of these metals are unsuitable as the arcing electrode in gallium-based electrical switches since each may be eroded by the harsh conditions created by the electrical arc that results whenever an electrical circuit is made or broken. Consequently, high temperature arc operations may result in these electrodes melting away in gallium-based switches.

In view of the above drawbacks and problems, it is apparent that a need exists for a novel approach to gallium-based electrical switch construction which will reduce or eliminate such drawbacks and problems.

SUMMARY OF THE INVENTION

An object of the present invention is to provide an improved gallium-based electrical switch.

In accordance with the present invention there is provided an electrical switch comprising a housing defining a cavity, at least two spaced electrodes, each electrode extending through the housing into the cavity, and wherein at least one of said at least two electrodes is composed of tantalum or a tantalum alloy, and a moveable amount of liquid gallium or liquid gallium alloy within the cavity to electrically connect and disconnect any two of said at least two electrodes as a result of movement of the housing.

An advantage of the present invention is providing a gallium-based electrical switch in which the electrodes withstand degradation by the gallium or the electrical arc to a better degree than the electrodes in gallium-based switches in the prior art.

BRIEF DESCRIPTION OF THE DRAWINGS

The present invention may be further understood from the following detailed description, with reference to the figures in which.

DETAILED DESCRIPTION OF THE INVENTION

The interaction of the commonly used metals for electrodes in mercury-based electrical switches with liquid mercury were analysed to explain why these metals function well in such switches. Phase diagrams between each of these metals and mercury were studied.

Figure 1:
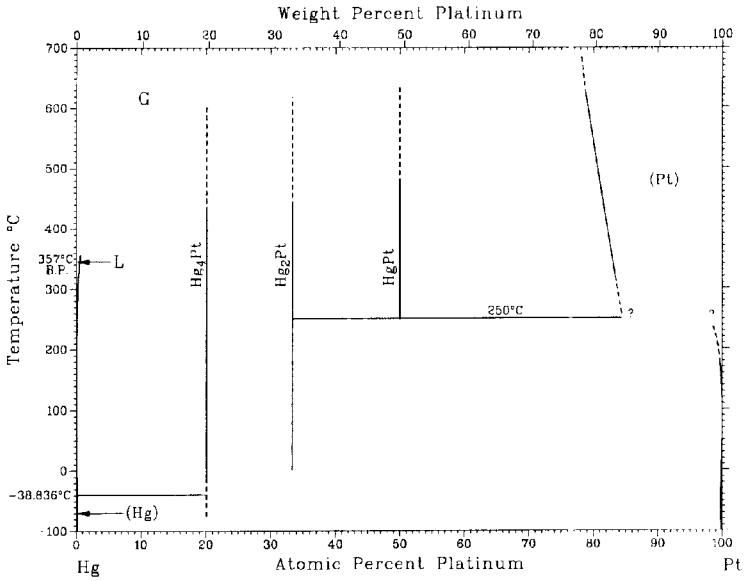
FIG. 1 is a phase diagram between mercury and platinum.

Referring to FIG. 1, there is shown a phase diagram between platinum and mercury. It may be observed that platinum forms a high melting point intermetallic compound ($Hg_4Pt$) which is wetted by mercury, meaning that mercury adheres to and coats the intermetallic compound with a layer of mercury. The formation of this intermetallic compound occurs when mercury contacts platinum as indicated by the mercury rich portion of the phase diagram (left side) where mercury coexists with $Hg_4Pt$. The intermetallic coated platinum is wetted to mercury. In the environment of an electrical switch, the surface of the platinum electrode forms this electrically conductive intermetallic upon which a layer of mercury adheres. The electrical arc in this kind of switch configuration may be between the mercury melt pool and the mercury on the surface of the platinum electrode, the effect of which may be to protect the platinum electrode from damage caused by electrical arcing.

Figure 2:
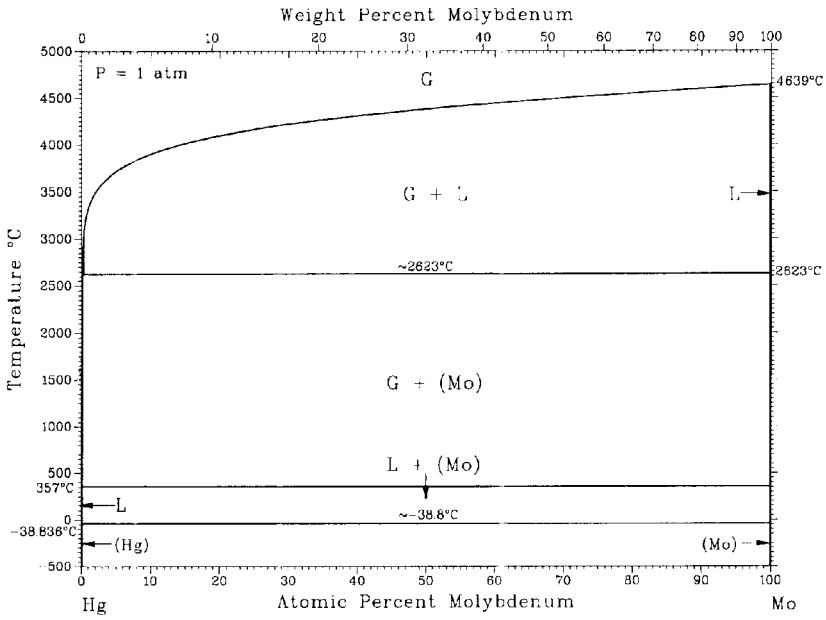
FIG. 2 is a phase diagram between mercury and molybdenum.

Referring to FIG. 2, there is shown a phase diagram between molybdenum and mercury from which it may be observed that molybdenum has no solubility in mercury. As a result, molybdenum electrodes are not usually decomposed or attacked by dissolution by the mercury in mercury-based electrical switches. And because of the high melting point of molybdenum, electrodes composed of molybdenum are not usually damaged for example by pitting due to volatilisation by the electrical arc. There are no intermetallics formed between molybdenum and mercury.

Figure 3:
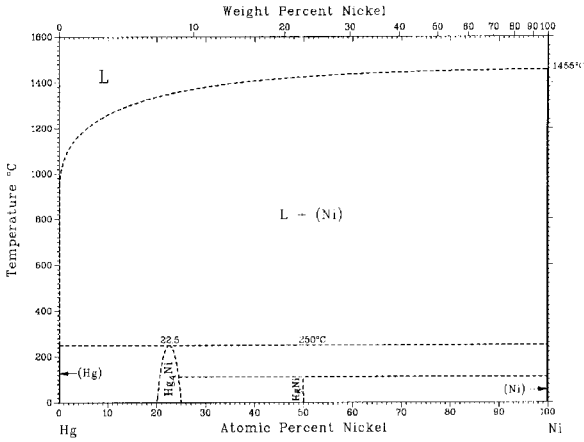
FIG. 3 is a phase diagram between mercury and nickel.
Figure 4:
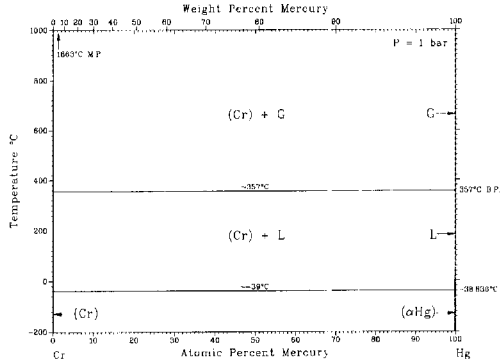
FIG. 4 is a phase diagram between mercury and chromium.
Figure 5:
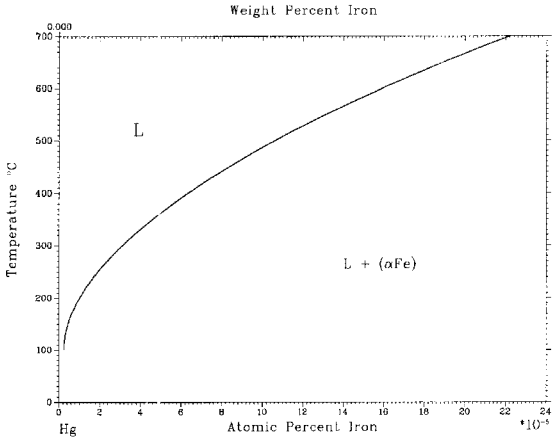
FIG. 5 is a phase diagram between mercury and iron.

Referring to FIGS. 3, 4 and 5, there are shown phase diagrams for nickel and mercury, chromium and mercury, and iron and mercury, respectively. All three metals have no solubility in mercury thus each metal functions well as non-arcing common electrodes in mercury-based electrical switches. However, because of the relatively low melting point of each of these metals, they are not generally suitable for use as arcing electrodes since the heat created from the arc may result in the degradation of such electrodes.

Phase diagrams for the interaction of each of the metals platinum, molybdenum, tungsten, chromium, nickel and iron with gallium were analysed to determine why these metals did not work well in gallium-based electrical switches.

Figure 6:
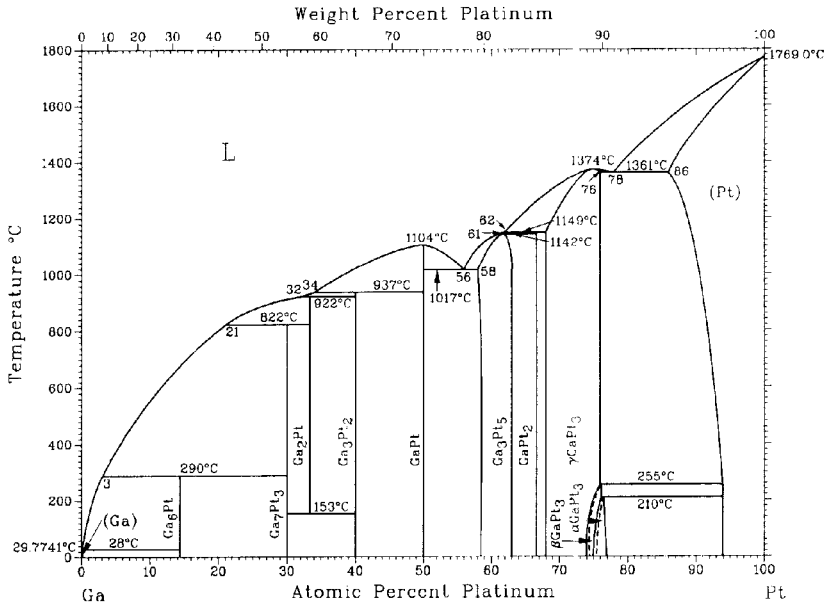
FIG. 6 is a phase diagram between gallium and platinum.

Referring to FIG. 6, there is shown a phase diagram for platinum and gallium which reveals that platinum interacts with gallium to form intermetallic compounds that have relatively low melting points of approximately 290° C. and 822° C. respectively. These intermetallic compounds may melt away during operation of a gallium-based electrical switch, especially during arcing. As well, the intermetallic compounds may also be brittle and fracture away from the electrodes during switch operation. The intermetallic compounds also need to be conductive enough to carry the electrical current.

Figure 7:
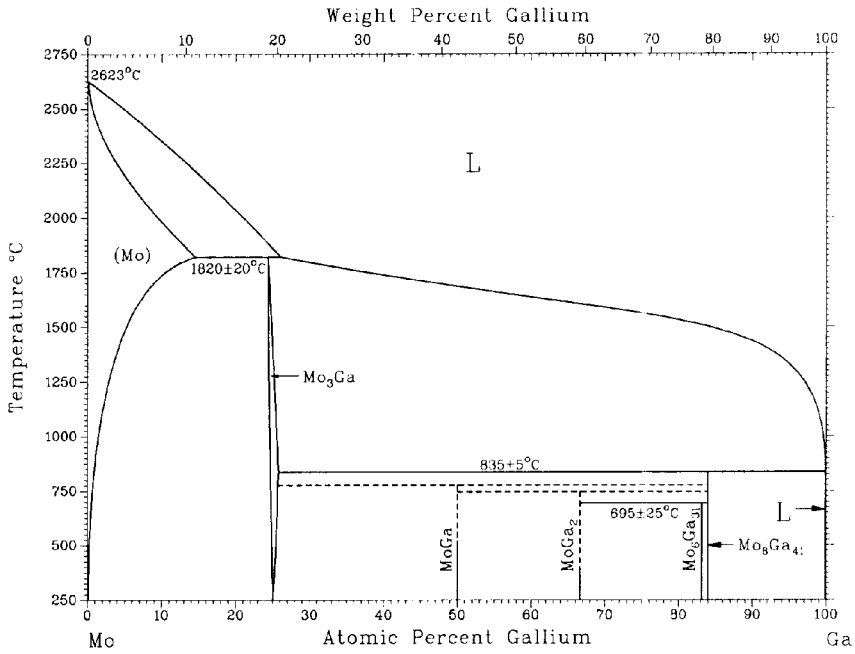
FIG. 7 is a phase diagram between gallium and molybdenum.

Referring to FIG. 7, there is shown a phase diagram for molybdenum and gallium which reveals that molybdenum interacts with gallium to form an intermetallic compound that has a relatively low melting point of approximately 835° C. This intermetallic compound may melt or fracture away from the electrode during operation of a gallium-based switch.

Figure 8:
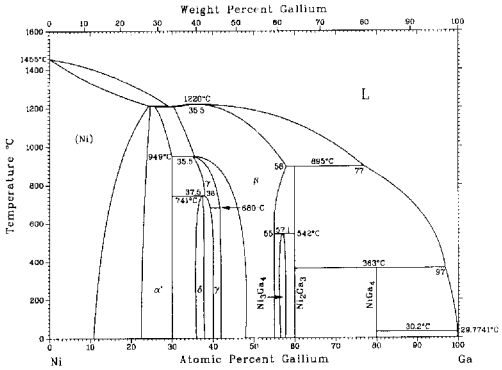
FIG. 8 is a phase diagram between gallium and nickel.
Figure 9:
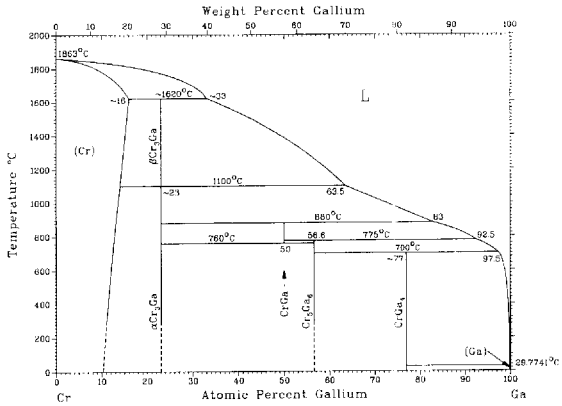
FIG. 9 is a phase diagram between gallium and chromium.
Figure 10:
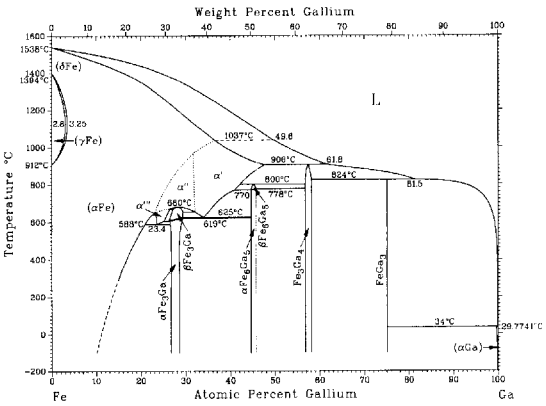
FIG. 10 is a phase diagram between gallium and iron.

Referring to FIGS. 8, 9 and 10, there are shown phase diagrams for nickel and gallium, chromium and gallium, and iron and gallium, respectively. All three metals have a significant solubility in gallium resulting in decrease in size of electrodes composed of these metals when placed in liquid gallium or liquid gallium alloy, especially when the contact between gallium and these elements are made at elevated temperature. The problems of this dissolution include loss of electrode material as well as change in the chemistry of the gallium alloy which may increase the melting point of the gallium alloy freezing it from the liquid state.

Figure 11:
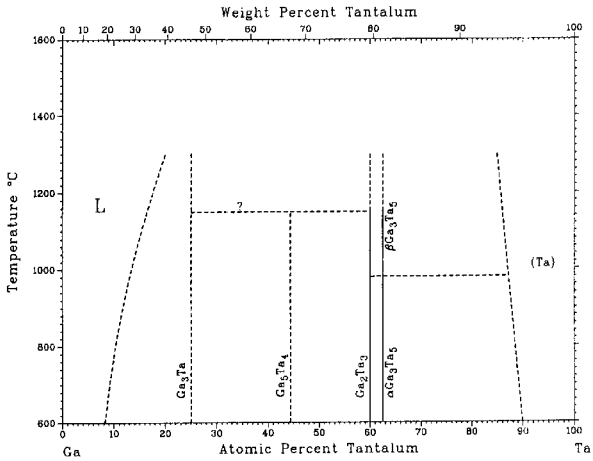
FIG. 11 is a phase diagram between gallium and tantalum.

Surprisingly, it has been discovered that electrodes or contacts composed of tantalum metal work with gallium metal or gallium alloys and do not have the drawbacks of the prior art. Tantalum has been found to be well suited to function as the common and arcing electrode in gallium-based electrical switches. Referring to FIG. 11, there is shown a phase diagram of tantalum and gallium. It may be observed that tantalum and gallium, when exposed to high temperature form an intermetallic compound ($Ga_3Ta$) having a relatively high melting point. This intermetallic compound is found to be wetted by gallium such that a film of liquid gallium forms on the tantalum electrode. Also the intermetallic compound does not break away by the brittleness of the compound and, surprisingly, exhibits excellent electrical conductivity. Consequently, the electric arc occurs between the liquid gallium conductor and the gallium wetted to the tantalum electrode. This may be a unique situation that, when coupled with the high boiling point of gallium (>2000° C.) results in a gallium-based electric switch having a high temperature capability in which high currents can be carried by sustaining high temperature arcs without resulting in electrode failure.

In addition to pure tantalum, alloys of tantalum may also be used effectively. Tantalum alloys are solid solutions of tantalum with minor additions of a second element or a combination of second elements, such as for example, Niobium (Nb), Molybdenum (Mo), Titanium (Ti), Vanadium (V), Tungsten (W), Aluminum (Al), Nickel (Ni), Iron (Fe), Chromium (Cr), Gold (Au), Palladium (Pd), Platinum (Pt), Rhenium (Re), Rhodium (Rh), Ruthenium (Ru), and Silicon (Si). The electrical discharge properties are expected to be similar to that of pure tantalum. Two phase alloys of tantalum can be formed by adding increased amount of the second element or combinations thereof. Single phase alloys of tantalum are expected to be more malleable compared to two phase alloys and thus are preferred over two phase alloys due to their malleability and their more uniform electrical arc discharge properties.

Figure 12:
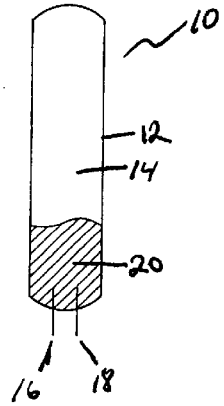
FIG. 12 is a vertical sectional view of a gallium-based electrical switch in a position where the electrical circuit of the switch is closed.
Figure 13:
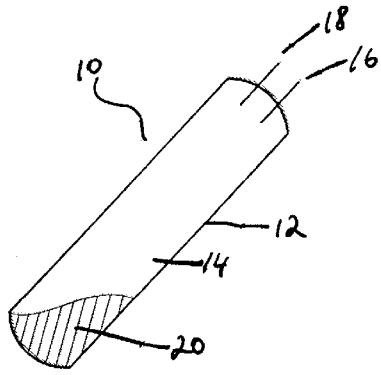
FIG. 13 is a vertical sectional view of a gallium-based electrical switch in a position where the electrical circuit of the switch is open.

Referring to FIGS. 12 and 13, there is illustrated an electrical switch in accordance with an embodiment of the present invention. The electrical switch 10 is shown in a position wherein the electrical circuit through the switch is closed. Electrical switch 10 is comprised of ampoule or housing 12 that defines cavity 14. Housing 10 is usually made out of glass, but may be made out of any other suitable material as would be apparent to a person skilled in the art. At least two spaced electrodes 16 and 18 are provided such that each electrode extends through the housing 12 into the cavity 14 so as to be able to conduct electricity from the cavity 14 to outside of the housing. It will be apparent to a person skilled in the art that more than two electrodes may be used and there may be many possible configurations of electrodes to provide the desired electrical switching action. At least one of the electrodes 16 and 18, or both, is made or comprises of tantalum. Preferably, all of the electrodes would be tantalum. Within the cavity 14 is provided a melt pool or amount of liquid gallium or a liquid gallium alloy 20 in an amount sufficient to electrically connect and disconnect any two electrodes as a result of movement of the housing. The amount of liquid gallium or liquid gallium alloy 20 bridges the spaced electrodes 16 and 18 as shown in FIG. 1 thereby connecting the electrodes electrically.

Referring to FIG. 13, the electrical switch 10 is shown in a position wherein the electrical circuit through the switch is open. Electrical switch 10 is physically oriented in a manner such that the amount of liquid gallium or liquid gallium alloy 20 does not bridge electrodes 16 and 18 such that an electric current may not flow between the electrodes.

Figure 14:
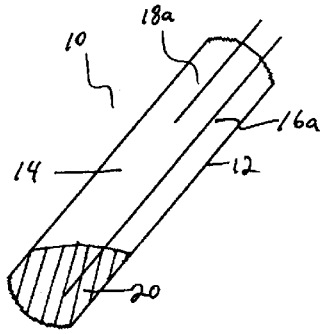
FIG. 14 is a vertical sectional view of a gallium-based electrical switch with common and arcing electrodes in a position where the electrical circuit of the switch is closed.
Figure 15:
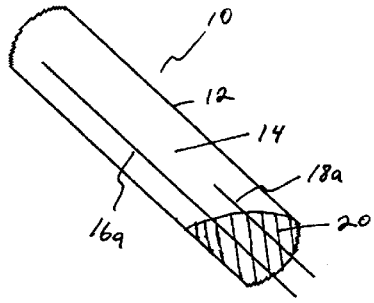
FIG. 15 is a vertical sectional view of a gallium-based electrical switch with common and arcing electrodes in a position where the electrical circuit of the switch is open.

Referring to FIGS. 14 and 15, there is illustrated the electric switch 10 in a position wherein the electrical circuit through the switch is open (FIG. 14) and closed (FIG. 15), except that one of the electrodes referred to as common electrode 16*a* remains in contact with the amount of liquid gallium or liquid gallium alloy 20 throughout the positioning of the switch, while arcing electrode 18*a* intermittently contacts the amount of liquid gallium or liquid gallium alloy 20 as a result of changes in the switch orientation, as shown in FIG. 15. In an electric switch configuration in which there is a common electrode and one or more arcing electrodes, generally, only the arcing electrodes would be tantalum, though it may be preferable to have all of the electrodes to be comprised of tantalum.

In some embodiments, tantalum wires may be used inserted into the ampoule, which carries the gallium alloy melt. In other embodiments, tantalum wire may be welded or brazed to low thermal expansion lead material, which is compatible with glass thermal expansion, thereby forming a good metal to glass seal. Generally, only the arcing electrode may be made from tantalum. However, since tantalum wire is not degraded by gallium, it could also be used as the non-arcing common electrode.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. In the specification, the word "comprising" is used as an open-ended term, substantially equivalent to the phrase "including, but not limited to", and the word "comprises" has a corresponding meaning. Citation of references herein shall not be construed as an admission that such references are prior art to the present invention. All publications, including but not limited to patents and patent applications, cited in this specification are incorporated herein by reference as if each individual publication were specifically and individually indicated to be incorporated by reference herein and as though fully set forth herein.

What is claimed is:

1. An electrical switch for use under high temperature arcing conditions which create harsh conditions that cause electrode melting away and fracture, comprising:

a) a housing defining a cavity;

b) at least two spaced electrodes extending through the housing into the cavity, and wherein at least one of said at least two electrodes is comprised of tantalum to withstand the harsh conditions and minimize electrode melting away and fracture; and c) a moveable amount of liquid comprised of gallium within the cavity to electrically connect and disconnect any two of said at least two electrodes as a result of movement of the housing.

2. The electrical switch of claim 1 wherein at least one of said at least two electrodes is composed of gallium wetted tantalum.

3. The electrical switch of claim 2 wherein the gallium wetted tantalum is a gallium wetted tantalum alloy.

4. The switch of claim 3 wherein the liquid gallium alloy is an alloy comprised of gallium (Ga), indium (In), and tin (Sn).

5. The switch of claim 4 wherein the liquid gallium alloy is an alloy comprised of 62.5% gallium (Ga), 21.5% indium (In), and 16% tin (Sn).

6. The switch of claim 3 wherein the tantalum alloy is a single phase tantalum alloy with elements selected from any of the following: Niobium (Nb), Molybdenum (Mo), Titanium (Ti), Vanadium (V), Tungsten (W), Aluminum (Al), Nickel (Ni), Iron (Fe), Chromium (Cr), Gold (Au), Palladium (Pd), Platinum (Pt), Rhenium (Re), Rhodium (Rh), Ruthenium (Ru), or Silicon (Si).

7. In an electrical switch including a cavity in which an amount of liquid gallium is movable and including an electrode extending into the cavity, the switch operating so that the liquid gallium moves into and out of contact with the electrode to open and close the switch, which produces arcing and high temperature conditions that result in electrode melting away and fracture the improvement comprising the use of tantalum in the electrode to reduce erosion and breaking.

8. The switch of claim 7 wherein the interaction between the tantalum and the gallium at high temperatures forms an intermetallic compound.

9. The switch of claim 8 wherein the intermetallic compound is wetted by gallium so that a film of liquid gallium forms on the tantalum electrode.

10. The switch of claim 9 wherein during operation, electric arcing occurs between the liquid gallium and the gallium wetted to the tantalum electrode.

11. The switch of claim 9 wherein the intermetallic compound is Ga3Ta.

12. The switch of claim 8 wherein the high temperature is produced by arcing between the liquid gallium and the electrode.

* * * * *